United States Patent [19]

Stangl et al.

[11] Patent Number: 4,907,658

[45] Date of Patent: Mar. 13, 1990

[54] PERCUSSIVE MOLE BORING DEVICE WITH ELECTRONIC TRANSMITTER

[75] Inventors: Gerald A. Stangl, Perry; Douglas W. Lee, Enid; Dirk A. Wilson, Stillwater, all of Okla.

[73] Assignee: Gas Research Institute, Chicago, Ill.

[21] Appl. No.: 250,954

[22] Filed: Sep. 29, 1988

[51] Int. Cl.[4] ..... E21B 47/024; E21B 47/09

[52] U.S. Cl. ..... 175/19; 175/45

[58] Field of Search ..... 175/40, 45, 53, 19, 175/24, 26, 61, 62; 173/20, 21; 405/154, 184; 73/151; 181/102, 104; 340/870.1, 855; 367/25, 81, 911; 455/128

[56] References Cited

U.S. PATENT DOCUMENTS

| | | | |
|---|---|---|---|
| 3,465,834 | 9/1969 | Southworth, Jr. | 173/2 |
| 3,589,454 | 6/1971 | Coyne | 175/45 |
| 3,712,391 | 1/1973 | Coyne | 175/45 |
| 3,718,930 | 2/1973 | McCullough et al. | 340/855 |
| 3,746,106 | 7/1973 | McCullough et al. | 175/45 |
| 4,223,746 | 9/1980 | Tanguy et al. | 175/45 |
| 4,265,305 | 5/1981 | Stone et al. | 166/113 |
| 4,266,606 | 5/1981 | Stone | 166/319 |
| 4,445,578 | 5/1984 | Millheim | 175/45 |
| 4,592,432 | 6/1986 | Williams et al. | 175/19 |
| 4,621,698 | 11/1986 | Pittard et al. | 175/19 |
| 4,632,191 | 12/1986 | McDonald et al. | 175/19 |
| 4,674,579 | 6/1987 | Geller et al. | 405/184 |
| 4,694,913 | 9/1987 | McDonald et al. | 175/61 |
| 4,714,118 | 12/1987 | Baker et al. | 175/45 |

OTHER PUBLICATIONS

Publication, "Pierce Arrow", by The Charles Machine Works, Inc., 6/87.

Radiodetection Data Sheet No. 010, 2/87, issued by Radiodetection Corp., "Pipe and Cable Location Theory".

Radiodetection Data Sheet No. 080, 12/86, issued by Radiodetection Corp., "Sondes for Tracing and Locating Sewers, Drains and Ducts w/the RD300 Drain Locator, the RD400 or RD600 Locating Instruments".

Radiodetection Data Sheet No. 180, 8/86, issued by Radiodetection Corp., "Safe Working of Horizontal Boring Tools and Maximizing Their Use".

Radiodetection Data Sheet No. 130, 2/87, issued by Radiodetection Corp., "Incorporating a Position Transmitter in a No Dig Tool".

*Primary Examiner*—Bruce M. Kisliuk

*Attorney, Agent, or Firm*—Banner, Birch, McKie & Beckett

[57] ABSTRACT

A percussive mole boring device with a location transmitter is disclosed. The transmitter is located in a forward end of a drilling assembly attached to a mole to accurately transmit the location of a boring element or cutting surface to surface detector. The transmitter is surrounded on each end by isolator means which protect the transmitter from damage due to shock created by the percussive device, e.g., a hammer driven by compressed air. In one embodiment the transmitter is located beneath a single window transparent to the transmission frequency, and the cutting surface of the bore is angled. Therefore, the travel direction of the mole can be controlled by rotating the cutting surface to a desired inclination and terminating rotation during forward motion for a short period. The mole travels in a straight path during ordinary travel due to rotation. In a second embodiment, the transmitter is located beneath three equiangularly displacent windows to create a continuous field for detection. This type of mole is not steerable and includes a boring element with a non-angled edge. In a third embodiment which is similar to the second embodiment, the windows are not present, and a transmitter coil is wound in an external groove of the drilling assembly and is covered by epoxy.

7 Claims, 3 Drawing Sheets

PERCUSSIVE MOLE BORING DEVICE WITH ELECTRONIC TRANSMITTER

BACKGROUND OF THE INVENTION

1. Field of the Invention

This invention relates to a percussive mole for underground boring, such as for boring channels or passageways for underground utilities. More particularly, the invention relates to an electronic transmitter for surface detection of the location of the forward end of the mole.

2. Description of the Prior Art

Earth boring devices are known in the art and include both guided devices, for which the direction of forward progress of the mole can be controlled, and unguided devices. These devices are used for boring channels underground to allow for the installation of utility lines without necessitating the disturbance of surface obstacles, such as trees, fences, sidewalks and roads. For example, a hole may be bored beneath a road without closing the road and digging an open trench across it. The expense of rebuilding the road after installation of the utility is also avoided. If the obstacle is a building, an earth boring device allows for the installation of a utility line which would have been previously impossible.

A variety of boring tools are well-known for digging underground channels, including flexible rod devices, auger devices, pipe pushers, and air or hydraulic powered impact type piercing tools or percussive moles. The present invention is directed solely to percussive moles. These tools may or may not be guided or steerable once they enter the ground. Unguided, uncontrollable systems have a tendency to bury themselves, rise to the surface in the wrong position, or damage underground utility lines. Accordingly, they are used primarily for short bores of up to approximately 100 feet.

The forward or boring end of a percussive mole generally includes an anvil which is hit by an internal striker powered by compressed air. Generally, the rearward end of the mole is connected to a whip hose, which in turn is connected to a flexible air hose connected to a source of compressed air on the surface. One example of this type of mole is the PIERCE AIR-ROW® pneumatic underground piercing tool or mole. This percussive mole can also be adapted to both push or pull pipes through the ground.

Piercing tools or moles have been developed which provide both mechanical steering and orientation systems to overcome the problem of unguided devices. Typically a guided piercing tool consists of a slanted nose on a rotatable housing and an electronic instrumentation system for directional control. The slanted nose generates a deflective side force as the tool bores through the soil, thus permitting the operator to turn the tool in a desired direction. The means to appropriately rotate and control the tool are well-known and described in the literature.

FIG. 1 illustrates the general operation of a guided percussive mole earth boring tool as taught in commonly assigned U.S. Pat. No. 4,694,913 which is incorporated by reference. Drill rig 1 is disposed within launching pit 2 which is excavated to a depth below the level of desired horizontal bore hole 3 under a surface structure, for example, road 4. Drilling rig 1 is provided with an external source of compressed air 5 and is supported on tracks 6 within pit 2. The compressed air is linked to the drilling mole 7 which is supported at the forward end of hollow sectional drill rod 8. Drilling rig

1 supports drill rod 8 and permits the addition of further sections of rod as the drilling progresses through the earth.

Compressed air from compressed air source 5 is supplied through hollow drill rod 8 to pneumatic mole 7 which operates a hammer (not shown) to repeatedly contact an anvil member (not shown) connected to external boring element 9 having on angled cutting surface. Connector 10 is located between the rearward end of drilling mole 7 and includes a plurality of holes 11 for exhausting air from the drilling mole back into bore 3.

In order to avoid costly deviations from a desired path, it is important to know the position and direction of travel of a percussive mole at all times. This is important in both guided and in non-guidable percussive moles.

One solution known in the art to the problem of accurately determining the underground location of a mole is to use a transmitter (or sonde) attached to the mold. The transmitter transmits a signal to an above-ground receiver so that the location of the mole can be determined. However, because the transmitter must function in an extremely hostile environment of underground dirt and percussive boring, it is important to protect the transmitter as much as possible. For example, it is known to use a transmitter attached at the rear of the mole, such as to the whiphose linking the mole to the compressed air source. In this location the transmitter (or sonde) is relatively well protected from the high shock load on the mole body caused by the percussive impact. However, the exact location of the drilling bore element cannot be known with great accuracy, since the distance between the boring element at the front of the mole and the rear of the mole may be quite large, e.g., 3–6 feet. The mole would have to proceed for at least one body length before a detector located on the surface would detect that the mole was off-course. By this time it may have deviated to a large degree from the desired path and it may be too late to back the mole out of the bore to try a new bore, or in the case of a steerable boring device, correct the course of the mole back to its desired direction. Additionally, damage to sewers and utilities may have already occurred.

U.S. Pat. No. 3,746,106 (also incorporated by reference) shows a transmitter located in a housing between the boring bit and the bore pipe. The housing includes a "window", i.e., an area of the housing which allows transmission of a signal in the desired frequency range. The housing also includes a battery compartment and space for appropriate control circuitry. A rubber spacer is included in the battery compartment to continually urge the battery into contact with the terminal block.

Although the transmitter is located near the drill bit, the bit is designed to cut a hole through the earth by rotary action, progressively cutting the end face of the bore. Therefore, this design of the transmitter housing would be completely unacceptable in a percussive mole device since the impact on the mole creates shock forces which would quickly render the transmitter nonfunctional.

SUMMARY OF THE INVENTION

The present invention is percussive boring tool or percussive mole which includes a position transmitter located near the boring device to transmit an accurate location of the boring device to a surface detector.

Percussive means are provided for impacting the mole to move it through the ground. Typically, these percussive means include an internal striker which strikes a drilling assembly, such as an anvil in the forward or boring end of the mole. A whip hose is connected to the rearward end of the mole. The whip hose is, in turn, connected to a flexible air hose which is connected to a source of compressed air for powering the striker into the anvil.

The drilling assembly also includes a transmitter housing located behind but adjacent the forward or boring end of the mole. A transmitter is fixed in the transmitter housing. A battery for powering the transmitter also may be positioned in the housing. The transmitter housing includes at least one window transparent to the transmitter frequency and extending at least partially circumferentially around an exterior surface of the housing. A "window" is that portion of the housing which allows transmission from the transmitter, i.e., it does not block or otherwise interfere with the transmitted signal. Alternatively, a transmitter coil may be located externally in a groove of the housing and covered with protective epoxy. The transmitted signal is then detected by a surface detector. The transmitter and battery are isolated by high impact absorbers to protect it from damage due to the percussive drive mechanism.

DETAILED DESCRIPTION OF THE PREFERRED EMBODIMENTS

Figure 2:
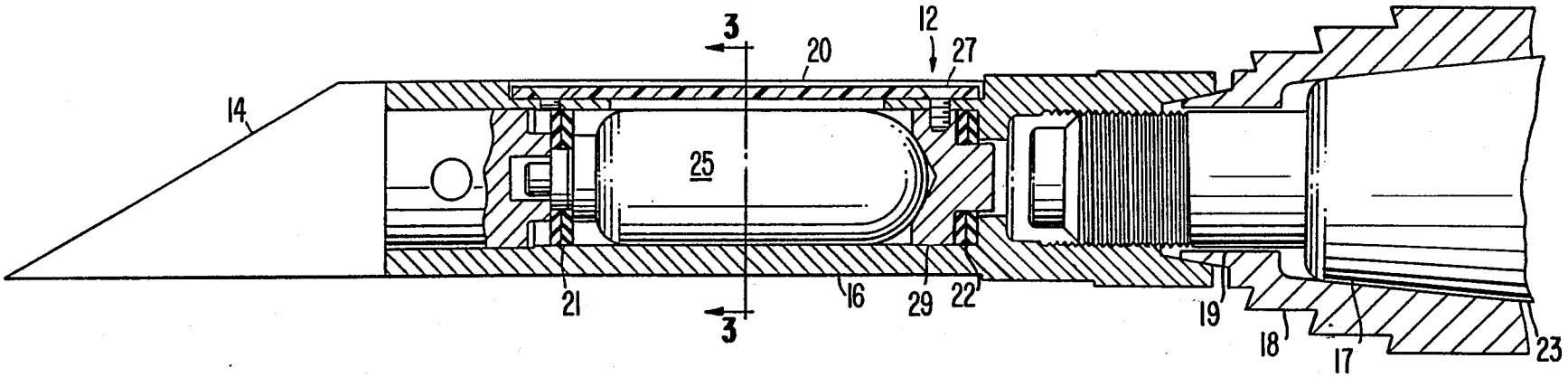
FIG. 2 shows a drilling assembly with a transmitter and housing according to one embodiment of the present invention.

FIG. 2 illustrates the invention in the context of a guided percussive boring device. As shown in FIG. 2, drilling assembly 12 includes forward end 14 with an angled cutting surface, transmitter housing 16 and hollow connecting element 18 with an open end surface attached within a hollow section at the rear of the transmitter housing. Mole 17 includes mole body 23 which is fitted into the hollow portion of connecting element 18 and anvil 19. Connecting element 18 is shown by way of example only, and any suitable means for connecting the mole to the assembly may be used. Anvil 19 is press fitted into mole body 23 and extends from the forward surface of mole body 23 into the hollow section of housing 16. Anvil 19 is threadedly engaged with housing 16. A hammer or striker (not shown) which is driven by compressed air is located within mole body 23 and repeatedly strikes the anvil causing forward movement of the drilling assembly.

The exact means of percussion do not form part of this invention and are known in the art, for example, in the PIERCE AIRROW ® tool discussed above. In this type of device, the mole body serves as an anvil or alternatively, the anvil may be a separate part press fit into the tapered forward end of the body and function as a guide or pilot which is repeatedly struck by a hammer. The hammer is internal to the mole body and is driven by compressed air. It is forseen that the percussive mechanism can be adapted for whatever the circumstances require and the present invention is not limited to any particular type of percussive mechanism. For example, the mole may be of one piece, threadedly connected to the rear of the transmitter housing. FIG. 2 shows a two piece design for the mole.

Figure 1:
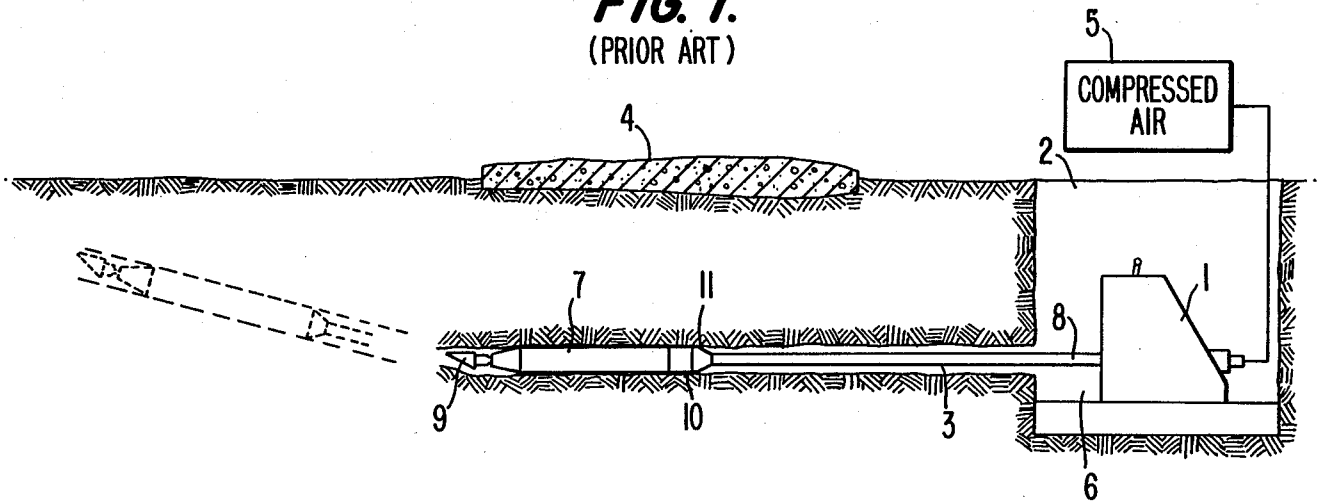
FIG. 1. (PRIOR ART)
FIG. 1 shows a prior art drilling mole apparatus including a drilling rig and compressed air source.
Figure 3:
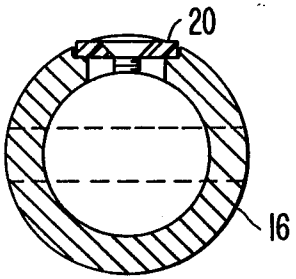
FIG. 3 shows a cross section of the transmitter housing along the lines 3—3 in FIG. 2.

Further with respect to FIGS. 2 and 3, housing 16 includes transmitter or sonde 25 located therein. The sonde may be of any known type and is commercially available. Plastic piece 29 is glued to the rear extension surface of sonde 25. Screw 27 is received within plastic piece 29 and prevents the sonde from rotating with respect to the angled cutting surface. Therefore, the orientation of the sonde with respect to the cutting surface may be known at all times.

Sonde 25 is located beneath window 20 which is transparent to the sonde's transmitting frequency and which extends along the circumferential surface of the housing, for example, for 20°. The remaining 340° may be made of material which is not transparent to the frequency. The sonde may be controlled by a suitable switch, e.g., a gravity sensitive mercury switch to transmit a continuous signal only when the window is exactly overhead, thus saving energy and providing not only the location of the mole, but also transmitting an accurate description of the orientation of the cutting surface of the boring element with respect to the bore. At all other times the sonde could transmit a pulse signal.

Sonde 25 is securely located between isolators 21 and 22 at both its front and rear ends. The isolators act as shock absorbers, absorbing the impact of the percussive hammer on the assembly. The hammer may strike at a rate of 350–800 blows per minute. The isolators can be made of any suitable material, for example, a stack of neoprene washers or commercially available ring-type isolators. In order for the isolation to be effective, the sonde must be free to move slightly in the housing by providing diametric clearance beneath the window. Additionally, the isolation must be maintained by sealing the window against dirt or other contaminants. Finally, the battery and necessary electronics for the transmitter (not shown) must also be provided in the housing and protected by suitable isolators. These latter elements are commercially available and are known in the art.

The present invention not only allows for effective location of the mole, but also effective direction control when it is desired to change the course. For example, since the sonde may be provided with a control that emits a continuous signal only when the window is directly overhead, that is, when the sonde is "right-side-up", the exact orientation of the cutting surface can be known with accuracy. Thus, by rotating the mole to a desired degree when the percussive means are not operating, any orientation of the cutting surface can be achieved. Since the direction of movement of the mole is dependant upon the orientation of the cutting surface, and since this orientation is known, the forward progress of the mole can be directed by simply stopping progress (terminating percussion) when the window is directly overhead, rotating the mole a desired amount from its overhead orientation, proceeding a desired distance without rotation of the mole until the correct course is achieved, and continuing normal progress with both percussion and rotation.

Figure 4:
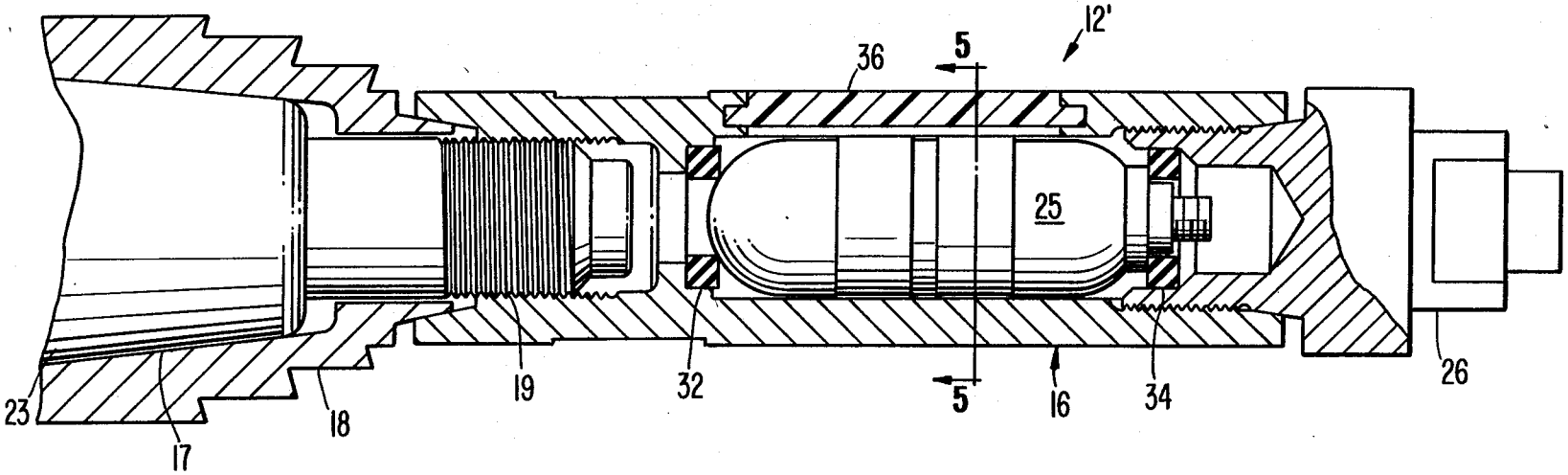
FIG. 4 shows a drilling assembly with a transmitter and housing according to a second embodiment of this invention.
Figure 5:
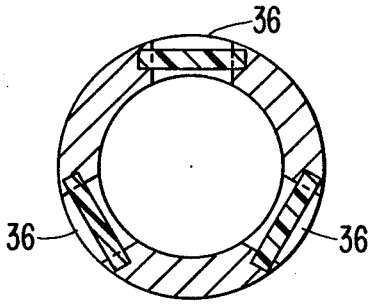
FIG. 5 shows a cross section of the housing along the lines 5—5 in FIG. 4.

A second embodiment of the present invention in the context of an unguided or nonsteerable mole is shown in FIGS. 4 and 5. Identical elements are denoted by the same reference numerals. Drilling assembly 12' of the second embodiment has boring element 26 threadedly attached at its forward end. The boring element does not include an angled surfaces or other means for providing directional control. Therefore, the drilling assembly is non-guided.

Sonde 25 is shielded between isolators 32 and 34 and is surrounded by three equiangularly located transparent windows 36. These windows, in conjunction with a continually transmitting sonde create a permanent electromagnetic field surrounding the mole near its forward end. Although this mole is not steerable since it does not have an angled cutting surface, the continuous field allows for the precise location of the mole.

In a third embodiment which is similar to the second embodiment, the drilling assembly includes a housing for only the battery and control electronics which are isolated as in the previous embodiments. However, the housing does not include the window as in the second embodiment. Rather, an externally wound transmitter coil is located in an external groove of the housing and is covered by epoxy to protect it from dirt and rocks. The coil is linked to the isolated battery and electronics within the housing.

This invention has been described in connection with the preferred embodiments. These embodiment, however, are merely for example only and this invention is not restricted thereto. It would be easily understood by those skilled in the art that variations and modifications can be easily made within the scope of the invention, as defined by the appended claims.

We claim:

1. In an unguided percussive mole boring device for use with a flexible hose connected to the mole boring device for providing a source of percussive power to drive the mole boring device, percussive means connected to the flexible hose and driven by a percussive power source for impacting the mole boring device, the improvement comprising:

a drilling assembly attached at a forward end of the mole boring device and a boring element attached to the forward end of said drilling assembly, said drilling assembly including a transmitter housing located behind and substantially adjacent said boring element;

an enclosed transmitter unit disposed within said transmitter housing, said transmitter unit enclosing a transmitter therein, said transmitter housing including a plurality of windows extending equiangularly around the circumferential exterior surface of said transmitter housing, said windows transparent to the frequency of transmission of said transmitter, said transmitter unit located substantially adjacent a forward end of said mole boring device to accurately transmit the location of the forward end of said boring element; and isolation means disposed in said housing for isolating said transmitter from shocks created by said percussive means impacting on said mole boring device, a diametric clearance provided between said transmitter unit and said windows allowing for axial movement of said transmitter unit in said housing to effectively cushion said impacts.

2. The device recited in claim 1, wherein each of said windows extends approximately 20° across the exterior surface of said transmitter housing, said 20° measured in a plane perpendicular to the longitudinal axis of the transmitter housing.

3. The device recited in claim 1, said isolation means comprising first and second isolation elements disposed about opposite ends of said transmitter unit.

4. The device recited in claim 3, wherein said first and second isolation elements each comprise a stack of neoprene washers.

5. A percussive mole boring device for use with percussive means for impacting thereon, said device comprising:

a mole having a forward end and a rearward end;

a boring element attached to the forward end of said mole;

a transmitter housing located behind said boring element and substantially adjacent said boring element;

an enclosed transmitter unit disposed within said transmitter housing, said transmitter unit enclosing a transmitter therein, said transmitter housing including at least one window extending at least partially circumferentially around an exterior surface of said housing, said window transparent to the frequency of transmission of said transmitter, said transmitter unit located substantially adjacent said forward end of said mole boring device to accurately transmit the location of the front portion of said mole boring device; and isolation means disposed in said housing for isolating said transmitter from shocks created by said percussive means impacting on said device, a diametric clearance provided between said transmitter unit and said window allowing for axial movement of said transmitter unit in said housing to effectively cushion said impacts.

6. The device recited in claim 5, said isolation means comprising first and second isolation elements disposed about opposite ends of said transmitter unit.

7. The device recited in claim 6, said first and second isolation elements each comprising a stack of neoprene washers.

* * * * *